United States Patent [19]

Lozano

[11] Patent Number: 4,832,388

[45] Date of Patent: May 23, 1989

[54] DOOR ASSEMBLY AND COMPONENTS THEREOF APPLICABLE TO INCREASE RESISTANCE TO FORCED ENTRY

[76] Inventor: Anthony R. Lozano, P.O. Box 7107, San Jose, Calif. 95150-7107

[21] Appl. No.: 839,739

[22] Filed: Mar. 14, 1989

[51] Int. Cl.[4] ..... E05C 21/02

[52] U.S. Cl. ..... 292/340; 292/DIG. 53; 16/384; 16/382

[58] Field of Search ..... 292/340, 346, 337, 251, 292/DIG. 53; 70/450, 451, 416, 417, 418; 49/503, 462, 460; 16/384, 382

[56] References Cited

U.S. PATENT DOCUMENTS

| | | | |
|---|---|---|---|
| 186,105 | 1/1877 | Bristol | 16/382 |
| 210,686 | 12/1878 | Griffin | 16/384 |
| 526,323 | 9/1894 | Magovern | 70/450 |
| 695,472 | 3/1902 | Miller | 292/346 |
| 889,798 | 6/1908 | Markey | 16/384 |
| 1,083,529 | 1/1914 | Fletcher | 292/340 |
| 1,231,556 | 7/1917 | Bauer | 16/384 |
| 1,377,051 | 5/1921 | Augenbraun | 292/340 |
| 1,574,493 | 2/1926 | Leonard | 70/451 |
| 1,618,846 | 2/1927 | Rippien | 292/346 |
| 1,762,326 | 6/1930 | Brittingham | 292/340 |
| 2,470,735 | 5/1949 | Young | 292/340 |
| 2,497,189 | 2/1950 | Shaffer | 70/450 |
| 2,785,565 | 3/1957 | Schlage | 70/451 |
| 2,921,461 | 1/1960 | Schlage | 292/337 |
| 3,060,523 | 10/1962 | Benham | 70/450 |
| 3,152,825 | 10/1964 | Schlage | 292/340 |
| 3,231,928 | 2/1966 | Granert | 16/382 |
| 3,815,945 | 6/1974 | Lamphere | 292/340 |
| 4,065,162 | 12/1977 | Schlage | 292/340 |
| 4,118,827 | 10/1978 | Yamamoto | 49/381 |
| 4,143,443 | 3/1979 | Reyle | 16/382 |
| 4,183,568 | 1/1980 | Ferracane | 292/346 |
| 4,296,619 | 10/1981 | Widen | 70/451 |
| 4,304,027 | 12/1981 | Fazio | 16/382 |
| 4,397,168 | 8/1983 | Rotondi | 70/417 |
| 4,550,939 | 11/1985 | Babb | 292/340 |

FOREIGN PATENT DOCUMENTS

| | | | |
|---|---|---|---|
| 606720 | 12/1934 | Fed. Rep. of Germany | 70/451 |
| 1144150 | 2/1963 | Fed. Rep. of Germany | 292/340 |
| 2821137 | 11/1979 | Fed. Rep. of Germany | 16/382 |
| 3027246 | 2/1982 | Fed. Rep. of Germany | 70/452 |
| 1005384 | 4/1952 | France | 16/384 |
| 2457363 | 1/1981 | France | 292/340 |
| 108891 | 2/1924 | Switzerland | 16/384 |
| 412624 | 11/1966 | Switzerland | 16/384 |
| 2137689 | 10/1984 | United Kingdom | 16/382 |

*Primary Examiner*—Henry E. Raduazo
*Attorney, Agent, or Firm*—John J. Leavitt

[57] ABSTRACT

One of the most popular ways of gaining access to a locked premise is through forced entry of a door assembly. Presented is a door assembly incorporating a system of components cooperating in a door assembly to increase resistance to forced entry through such door assembly. Forced entry is generally defined as being an unauthorized entry accomplished by the use of force upon the physical components of the premises, generally doors and windows, and usually exterior entry doors. Such forced entry usually takes the form of battering on the door adjacent to the door lock assembly, or adjacent to the center hinge of the door, usually applied by one or more solid kicks delivered to the door. Presented is a door assembly incorporating a reinforcement plate for the door lock assembly, a strike plate of novel design cooperating with the door assembly to strengthen the union between the door lock assembly and the strike jamb of the door frame, and a reinforcement plate associated with one or all of the hinges to reinforce the union between the hinges and the hinge jamb. In one aspect, the invention includes readily available mass produced consumer installable components that are capable of resisting breaking or bending or splintering of associated wood members as by a pry tool, and in another aspect, includes the use of extraordinarily long screw fasteners driven through the associated component at an angle and to a depth that they engage structural members so that any attempted forced entry through the door imposes tension on one or more such screw fasteners and requires that the elongated screw fasteners be stripped axially from the wall structure before forced entry can be accomplished.

12 Claims, 10 Drawing Sheets

DOOR ASSEMBLY AND COMPONENTS THEREOF APPLICABLE TO INCREASE RESISTANCE TO FORCED ENTRY

BACKGROUND OF THE INVENTION

1. Field of the Invention

This invention relates to security door assemblies and particularly to solid stile and rail doors and solid core wood doors used as a component in a door assembly including a door frame, adjacent vertical horizontally spaced structural wall support members to which the door frame is attached, security reinforced hinges for pivotally mounting the door on the door frame, ad a lock assembly including a security reinforced face plate mounted in the door edge and cooperating with a security reinforced strike plate mounted on the strike jam of the door frame.

2. Description of the Prior Art

It is believed that the prior art relating to this invention resides in Class 292. A search of this class has revealed the existance of the following U.S. Pat. Nos. 1,688,626; 1,762,326; 1,924,806; 3,152,825; 3,159,416; and 4,065,162.

It is not generally known that a burglar can break into most homes with just one swift kick. In most instances, such kicks are delivered to an exterior entry door adjacent the lock assembly. Since most such doors are fabricated from soft wood, as are the strike and hinge jambs, they are not constructed to withstand such force. The bolt of the lock assembly, or the door, or the strike jamb split and break apart and thus give access to the premises. Accordingly, it is one of the objects of this invention to provide a door assembly reinforced in such a way that it resists forced entry by this modus operandi.

In a special report dated October 1984, Consumer Reports states that more than 5 million homes will be burglarized in the United States in that year, with something like 4 million dollars worth of property stolen. Continuing, the report points out that many insurance companies offer discounts on homeowner's insurance policies according to which measures are taken to minimize the likelihood of a home being burglarized.

Statistics collected from the San Jose, California Police Department, the City of San Jose being a city of approximately 650,000 people, indicate that the most likely month that a home will be burglarized is January, the most likely day of the week for burglaries is Friday, and the most likely four hour block of time is between 12 noon and 4 o'clock in the afternoon. From these statistics, it is apparent that window entry occurred in 45.4% of the entries, while door entry occurred in 38.3% of the entries. The location of the point of entry that appears to be most prevalent is the rear of the house, at 37.3% of the entries, with the front of the house accounting for 31.3% of the entries, and the side of the house accounting for 21.6% of the entries. Entries related specifically to doors, either front door or rear door, amounted to 17.7% for the front door, and 13.8% for a rear door.

From these figures, it is apparent that burglarizing of residences, whether they be homes, apartments, mobile homes, condominiums, duplexes or other types of premises, is very prevalent at least in San Jose, California, and from these figures it is presumed that such forced entries are just as prevalent in other comparable metropolitan areas. In the San Jose area, 72.6% of the entries occurred in houses. Only 14.3% occurred in apartments, with the remainder of the entries being spread between the other types of premises.

There are three general areas that may be pinpointed as weaknesses in a door assembly. One such area is the strike jamb at the strike plate. Most conventional door frames are prefabricated in mills from various softwoods. Such softwoods are susceptible to bending and splitting and do not provide a very secure structure to which to fasten the door hardware. For instance, the conventional strike plate used on most conventional door assemblies constitutes nothing more than a flat plate rarely more than 1/16" in thickness, and having a large aperture to receive the door latch or dead bolt. This flat plate is most usually morticed into the softwood strike jamb of the frame no more than the thickness of the plate, and is secured in position by two relatively short, approximately ½" wood screws that penetrate only the soft wood of the strike jamb. Because in most instances the strike plate is attached to the strike jamb adjacent the inside edge of the jamb, and because the recess in the jamb that receives the bolt further weakens the jamb, one strong kick on the door adjacent the lock assembly, is usually enough to split the wood from which the strike jamb is formed, or strip the thin metal plate and the screws from the softwood strike jamb. Accordingly, it is an important object of this invention to provide a system of hardware for a door assembly that resists forced entry by the imposition of kicks or other methods of battering to gain unauthorized entry.

The strike plate of most conventional door assemblies is recessed into the softwood strike jamb of the door frame, such strike plates nominally being approximately 1/16" in thickness. Accordingly, another object of the present invention is to replace such conventional relatively thin and fragile strike plates with a strike plate incorporating reinforcing bosses projecting from the back side thereof that are embedded in the strike jamb and are secured not only to the strike jamb but also to the much stronger structural wall support members to which the door frame is attached.

A still further object is to provide easily fabricated, easily installed door hardware, such as a strike plate that has been reinforced by thickening the area immediately surrounding the screw fastener to allow the screw head, although angled, to be flush with the face of the strike plate.

Still another object of the invention in connection with the application of a reinforced strike plate is the provision of elongated screw fasteners to support the strike plate, the screw fasteners being driven into and through the strike jamb and into the much stronger structural wall support members behind the strike jamb at an angle other than 90°, and preferably in a direction that will tend to impose a tensile force on the screws when unauthorized entry force is applied to the strike plate, thus minimizing the shearing force or bending force applied to the screw fasteners of conventional strike plates.

A second area of weakness is the conventional "bored" lock assembly of a conventional door, usually referred to as "bored" locks and "key-in-knob" locks and fitted to the door in two intersecting holes, one of which is bored in the door stile from one face through the other along an axis that is perpendicular to the door face and spaced approximately 2⅜" from the edge of the door. The second hole is bored into the edge of the door along an axis that is perpendicular to the axis of the first bored hole so that it extends diametrically of the first bore. This second bore receives the latch or dead bolt and is approximately $\frac{7}{8}''$ in diameter. It will thus be seen that the door edge portion that lies immediately adjacent the intersection of the two bores, extending between the first bore and the door edge and overlying the second bore, constitutes an extremely weak area in the door itself and is not strengthened by the usually thin and fragile face plate that is recessed into the edge of the door, and which provides an aperture for slidable bearing of the latch or bolt as it moves from an unlocked to a locked position. In fact, such conventional face plates contribute to the rupturability of this area of door. Accordingly, another object of the present invention is to provide a reinforced door-edge face plate for a lock assembly, the reinforced door-edge face plate adapted to be mortised into the door edge and having reinforcing bosses having a thickness at least three times the thickness of the remainder of the face plate, with the face plate and reinforcement bosses being secured to the lock stile of the door with substantially longer screw fasteners driven into the door edge at an angle other than 90° to the door edge so as to impose a compressive force on the material of the door.

Another object of the invention is to provide a reinforced door-edge plate as the face plate of a door lock assembly, whether the look assembly be of the cylinder, tubular or mortised type, and which is secured to the door stile by extraordinarily long screw fasteners that extend into the door stile at angles other than 90° to the face plate so as to reinforce the door stile against splitting.

The area of the door assembly immediately surrounding conventional hinge installations is the third weak area and is also susceptible to intrusion by strong kicks. The reason for this is that most conventional hinge jambs and doors are constructed from softwood, and the wood screws that are utilized to attach the hinge leafs to the door and to the hinge jamb are relatively short, generally no more than $\frac{3}{4}''$ or 1", and penetrate only the softwood frame member from which the jamb is constructed. Accordingly, another object of the invention is the provision of means associated with one or more of the hinges, that will resist forces imposed on the door that would tend to split the frame or to bend or shear the screws with which the hinges are attached to the hinge jamb.

In connection with the reinforcement of the hinge area, a more specific object of this invention is the embedding of a reinforcement boss mortised into the hinge jamb, underlying the associated leaf of the hinge and independently secured to the underlying hinge jamb and to the wall support member behind the hinge jamb by an elongated wood screw that penetrates these structural members at an angle other than 90°, with the associated leaf of the hinge being detachably secured to the reinforcement boss by a machine screw.

One of the problems inherrent in the mounting of door hardware is the proper placement of the hardware in relation to the door edge, the strike jamb and the hinge jamb. The problem arises because holes and recesses must be bored or mortised into these supporting members to receive the hardware. The custom in the industry is to provide a paper or card stock template which, when properly positioned and held on the door or jamb, permits marking of the center point of holes to be bored. The difficulty with such templates is that they must be folded by the installer, who is frequently not mechanically inclined, or it slips out of position prior to marking, thus resulting in improper placement of the holes. Accordingly, a still further object of the invention is the provision of reinforced face and strike plates and a hinge reinforcement boss that provides the means for punching a depression in the door edge or jamb at the appropriate location to mark the location where the holes should be bored.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the invention in one aspect comprises a complete door assembly which for purposes of definition may be defined as a unit composed of a group of parts or components which make up a closure for a passageway through a wall. For the purposes of this description, a door assembly comprises a door, hinges for mounting the door on a door frame, a locking device or devices, operation contacts such as handles, knobs, push plates, miscellaneous hardware and closures, the frame on which the door is hung, including the head frame member, the hinge jamb and the strike jamb, these latter door frame members being anchored to surrounding structural wall support members including a wall header associated with the head frame member and vertical structural wall support members defining the opening in which the door frame is fitted and anchored. These vertical structural wall members frequently constitute 2"×4" studs doubled to provide a nominal 4"×4" built-up wall member joined to other structural wall members by the header and top and bottom plates. In one aspect of the invention, the improvement resides in the reinforcement of the lock assembly by the mortising of the door edge and the placement of a boss-reinforced face of a plate in the door edge, secured to the door stile by elongated screw fasteners that penetrate the door stile at angles other than 90° so as to impose a compressive force on the wood fibers of the stile, the reinforced face plate having projecting bosses which nest in the door stile behind the face plate of the lock assembly In another aspect of the invention, there is provided a reinforced strike plate that is mortised into the strike jamb of the frame and secured to the strike jamb and to the underlying wall support members by elongated screw fasteners that penetrate both the strike jamb and the underlying structural wall support members at an angle other than 90°. Reinforcement of the union between the strike jamb and strike plate includes a pair of projecting bosses on the rear side of the strike plate that lie snugly embedded in appropriate bores in the strike jamb. Thirdly, in still another aspect, the door assembly of the invention includes reinforcement means associated with one or more of the hinges, the reinforcement means being snugly embedded in the hinge jamb, independently attached to the hinge jamb and to the structural wall support member supporting the hinge jamb by an elongated screw fastener set at an angle other than 90° to the face of the hinge jamb, and to which independently anchored reinforcement means the associated hinge leaf may be detachably secured by a machine screw.

In a fourth aspect, considering the entire door assembly as previously defined, the invention includes a reinforced face plate as an article of manufacture for strengthening the door edge associated with the lock assembly, a reinforced strike plate for reinforcing the union between the strike jamb and the lock assembly, and a reinforcement member associated with one or more of the hinges and the associated hinge jamb, to prevent entry through the door by destruction of the union between a hinge or hinges and the associated hinge jamb.

DESCRIPTION OF THE PREFERRED EMBODIMENT

Figure 1:
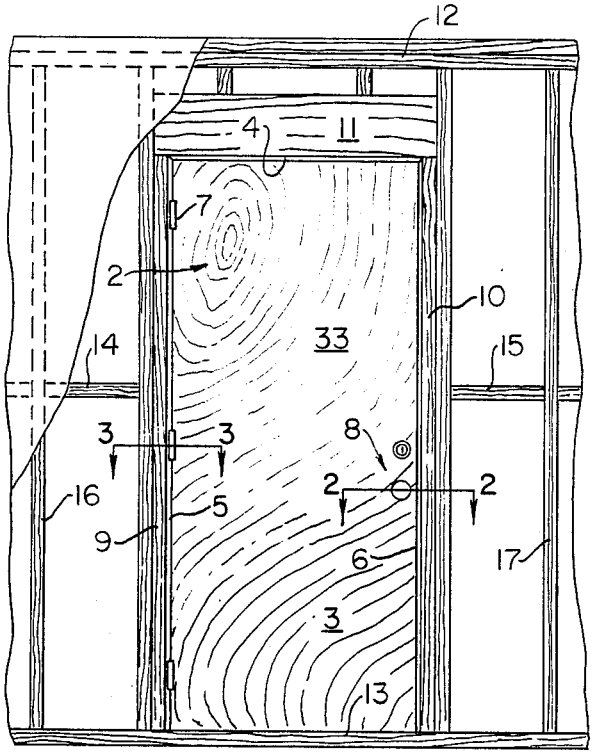
FIG. 1 is an elevational view in reduced scale of a complete door assembly according to my invention, including structural wall support members, portions of the wall being broken away to reveal the underlying structure. The view is approximately 6% of actual size.

An old adage states that locks on doors merely keep honest people out of locked premises, the adage implying that a dishonest person will disregard the lock and unlawfully gain entry into the premises. The need for protection against such unlawful entry appears to have increased by orders of magnitude in recent years. Law enforcement statistics indicate that crime in general, and burglaries of premises is on the rise. While the causes of such increase of criminal activity is a multi-faceted sociological problem that can and should be attacked in every conceivable way, steps can be taken in the meanwhile to mitigate the effects of this criminal activity as it relates to the unauthorized entry of premises.

As indicated above, one of the most likely modes of unauthorized entry is through exterior entry doors. While some such entries are through inadvertently unlocked doors, the majority occur by forced entry of locked doors. Such forced entries through locked doors occur frequently by simply delivering a strong kick to the door in the area adjacent the lock assembly. This of course indicates that the primary weak area in an entry door assembly is the union between the door edge and the strike jamb. Since the only physical connection between the door edge and the strike jamb occurs through the hardware that comprises the lock assembly, including the strike plate in the strike jamb, the face plate on the door edge, and the lock assembly mounted on the door, most inexperienced people naturally assume that the hardware is the most prone to failure under force exerted to gain unauthorized entry. Tests of complete door assemblies including solid core doors and conventional hardware indicate this is not the case.

Most entries are effected by failure of the door edge itself as distinguished from the hardware mounted on the door, or stripping of the strike plate from the strike jamb, usually because the strike jamb splits or ruptures in a way to release the strike plate. Tests have also indicated that the hinge jamb and the union of each hinge to the hinge jamb is another weak point that sometimes gives access to locked premises. One of the basic reasons for these weaknesses lies in the fact that, almost universally, where wood door frames are used, the wood is a softwood having little screw retention capability and, in recent years, such door frame wood usually comes from second or third growth trees, the wood of which is soft because of the large and thin walled cells, including numerous ducts. Softwooded trees are generally of rapid growth, making thick annual layers.

It is therefore surprising that in this age of technological advancement so little attention has been given to the solution of this problem of weakness of the door frame material. It is to these three areas of weakness that the subject matter of this invention is directed. Since millions of homes, apartments, condominiums and other premises are already equipped with conventional hardware, it is one of the objects of this invention to provide means that may be retrofitted to existing entry doors, in addition to installation in new construction. Also, since many homeowners or occupants of residences or other premises are mechanically inclined, although not professional locksmiths, the invention has been designed for facility of application by the consumer, even one having very little mechanical skill.

Thus, in terms of greater detail and referring to FIG. 1, the door assembly, and the means for reinforcing the door assembly, comprise a door assembly as designated generally by the numeral 2 in FIG. 1, the door assembly including the door 3, a door frame comprising a header 4, a hinge jamb 5, a strike jamb 6, hinges 7, and a lock assembly designated generally by the numeral 8 and including the strike plate illustrated in FIGS. 2 and 23–26 and the door edge plate of FIGS. 27–30, which conventionally form a part of a door assembly or door hardware. Also included in the definition of a door assembly are the vertical structural support members 9 to which the hinge jamb 5 is secured, the vertical support members 10 to which the strike jamb 6 is attached, and a header 11 to which the door frame head member 4 is attached. It will of course be understood that when the wall is erected, the wall support members 9 and 10 are plumbed with respect to the top plates 12 and the bottom plate 13. Ideally, the structural support members 9 and 10 are supported against lateral displacement by the interposition of spacer block 14 and 15 between the members 9 and 10, respectively, and adjacent vertical structural members 16 and 17. This type blocking should ideally extend all the way to the corner posts for each wall. The blocking serves several functions, but with respect to security it discourages, perhaps even prevents, lateral bowing of the structural members by application of a spreader bar between the hinge and strike jambs to release the latch and dead bolt from their respective sockets.

Figure 2:
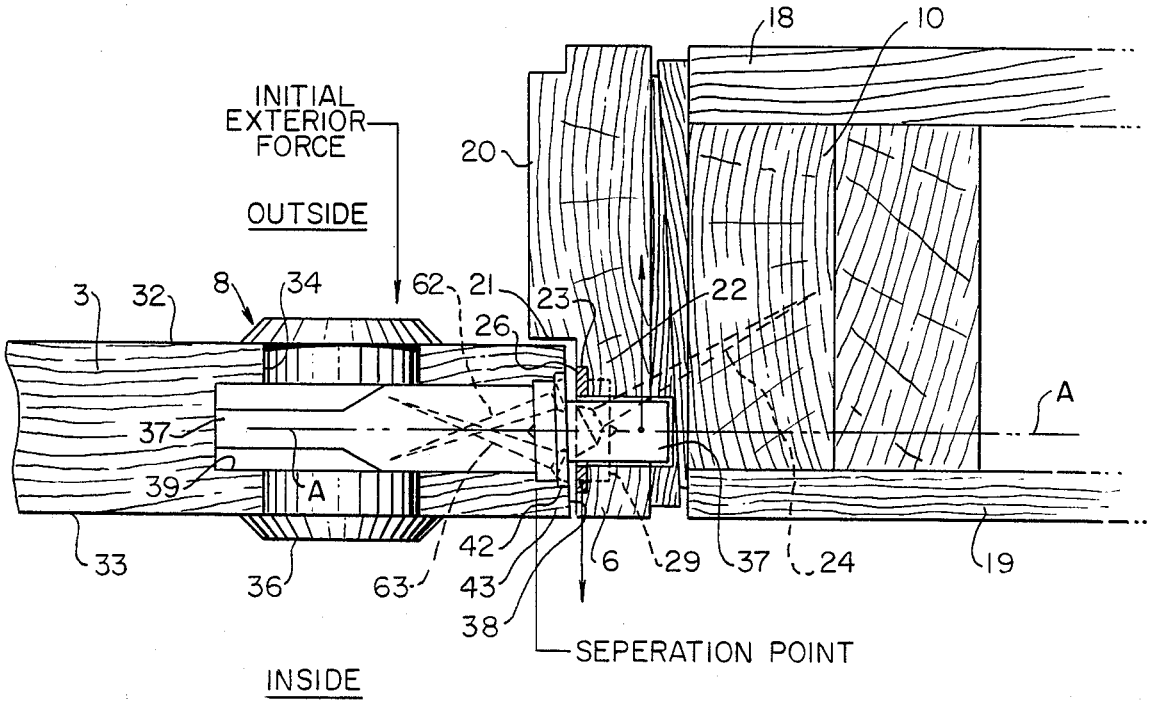
FIG. 2 is a fragmentary horizontal cross-sectional view taken in the plane indicated by the line 2—2 in FIG. 1, shown approximately 65% actual size to more clearly illustrate my invention.

Referring to FIG. 2, it will there be seen that the fragmentary portion of the door assembly illustrated, and incorporating my invention, includes the wall support member 10, to which is attached the outer siding member 18 and the inner wall surface material 19. The outer siding 18 may be fabricated from lumber, or it may be metal panels securely attached to the studs 9 and 10 as illustrated. In like manner, the wall covering 19 may be wood paneling or, more conventionally, may be plaster or sheet rock, so called "dry wall" construction.

Securely fastened to the vertical support members 10, which in home construction conventionally comprise a pair of 2"×4" studs nailed face-to-face as illustrated, is the strike jamb 6 which in this instance is provided with an integral door stop 20 having a shoulder 21 against which the door 3 abuts when closed, the shoulder 21 being formed by a relatively wide rabbet formed in the surface of the jamb 6.

Mortised into the rabbetted edge portion 22 of the jamb 6, is a strike plate 23 which is snugly nested in the strike jamb 6 in appropriately routed recesses formed therein. The strike plate 23 is securely fastened to both the strike jamb 6 and to the vertical structural support members 10 by a pair of elongated screw fasteners 24 which, as illustrated in FIG. 2, penetrate the strike plate 23, the jamb 6 and the vertical support members 10 at an angle other than 90° to the face of the strike plate. I have found that a preferred angle is about 30° to the face 26 of the strike plate 23. The strike plate is provided adjacent each opposite end with a bore 27 that passes through the thickness of the strike plate at an angle of about 30° to accommodate the elongated screw fastener 24. Additionally, the strike plate is provided with a generally symmetrically centered aperture 28 dimensioned to snugly receive the dead bolt (or spring latch) of the lock assembly 8 mounted in the door 3. To accommodate the kinds of pressure that a strong kick or other battering force might impose on the strike plate, the strike plate is conveniently formed from metal, preferably brass, and is approximately ⅛" thick and possesses a width of approximately 35% of the length of the strike plate. Additionally, the strike plate is provided adjacent each opposite end with a reinforcing boss 29 integral with the strike plate and forming a part thereof, the bores 27 extending therethrough at an angle of about 30° to accommodate passage of the screw fastener 24. In the embodiment illustrated the bosses 29 are spaced on opposite sides of the central aperture 28, and the rabbetted portion 22 of the jamb 6 is morticed to receive the generally rectangular plate 23, and two recesses are formed in the bottom of the morticed section to snugly receive the bosses. It is important to note that the bosses are embedded in the jamb but do not extend all the way through the jamb. It is also important to note that the recesses which snugly receive the bosses are not through holes in the jamb, but rather bottom out approximately midway through the thickness of the rabbetted jamb portion 22. Because of this construction and relationship of the bosses to the jamb, any unauthorized entry force against the door causes the bosses to impose a shearing stress on the wood of the jamb rather than a stress tending to split the jamb.

As indicated above, the strike plate 23 shown in FIG. 2 is shown in greater detail in FIGS. 23–26, where it is seen that each of the bosses 29 is provided with a conical projection 31 centrally located on each boss and useful to mark the jamb with a depression during installation to guide the installer in boring the recesses to receive the bosses. I have found that a 3 ½" length for the strike plate is a convenient length and provides sufficient strength and reinforcement to the strike jamb to withstand even the most enthusiastic efforts to break in, particularly in view of the fact that the screw fasteners 24 are inclined approximately 30° with respect to the surface of the plate, and extend for approximately 3" into the vertical wall support members 10.

Referring to FIGS. 1, 2, 8 and 9, door 3 as illustrated is preferably a solid core door having an exterior surface 32 and an interior surface 33. Bored through the door is a transverse bore 34 adapted to receive a key lock assembly 36 (FIG. 2) which includes a dead bolt 37 which extends into the door from the door edge 38 in an appropriate bore 39 formed into the edge of the door in a manner to intersect the bore 34. The edge of the door is mortised to provide a recess 41 within which is snugly nested the door edge reinforcement plate 42 as illustrated in FIGS. 2 and 27–30.

As illustrated in FIGS. 2 and 27–30, the plate 42 is preferably fabricated from metal, has a width less than the thickness of the door, so that when the recess 41 is formed in the edge of the door, an edge portion 43 of the door remains to cover the side edges 44 and 46 of the door edge reinforcement plate. Referring to FIGS. 27–30, it will be seen that the plate is generally rectangular, having square corners 47 rather than radiused or rounded corners simply because it is easier for the do-it-yourself consumer to provide a square-cornered recess in the edge of the door to receive the square-cornered plate than it is to provide a recess having rounded corners.

Figure 12:
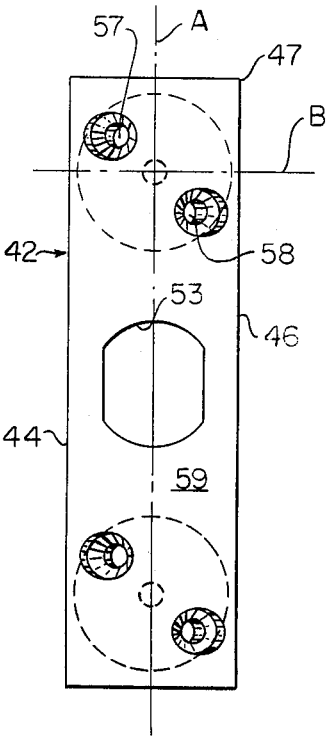
FIG. 12 is a front elevational view of the face plate of FIG. 11.
Figure 11:
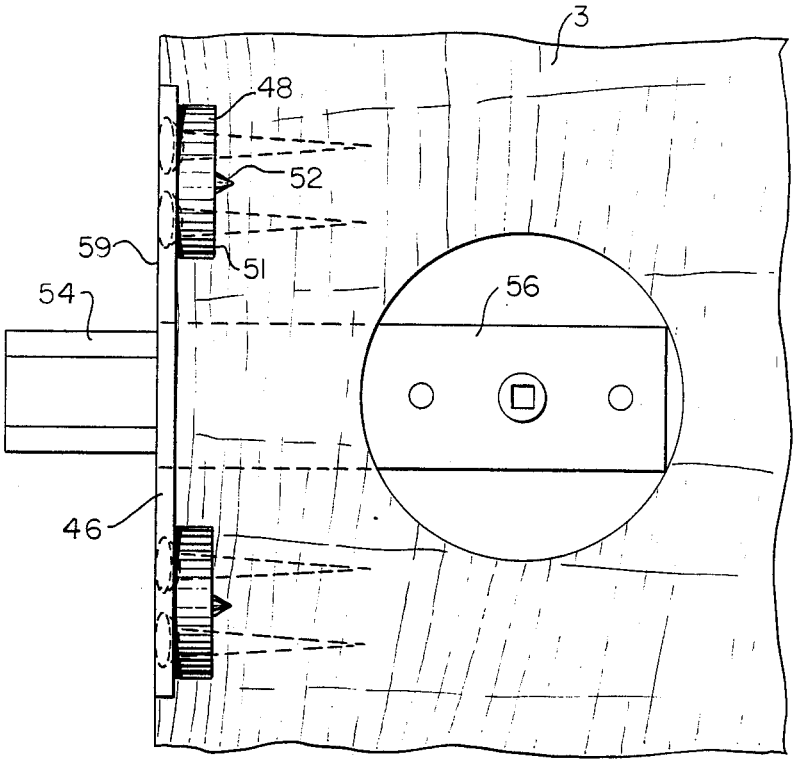
FIG. 11 is a side elevational view of a lock assembly incorporating my new face plate, shown actual size.
Figure 13:
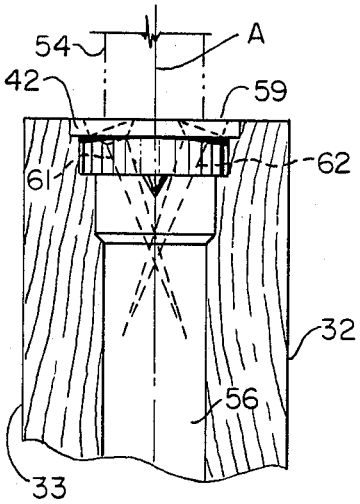
FIG. 13 is an end elevational view of the lock assembly, portions of the structure being broken away to reduce the size of the view.
Figure 15:
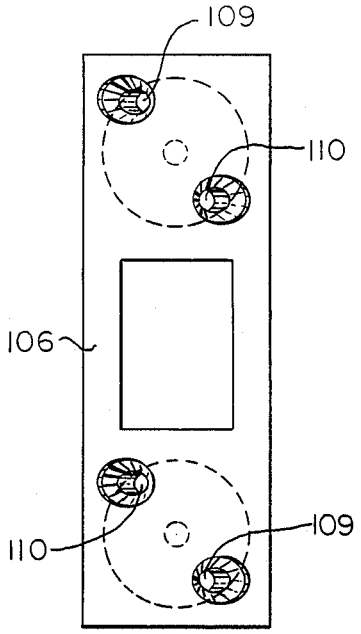
FIG. 15 is a front elevational view of the strike plate of FIG. 14.
Figure 17:
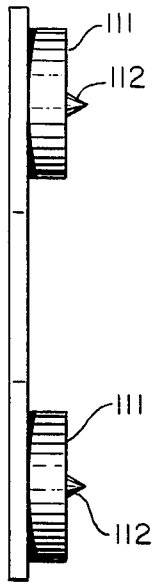
FIG. 17 is a side edge elevational view of the strike plate of FIG. 15.
Figure 18:
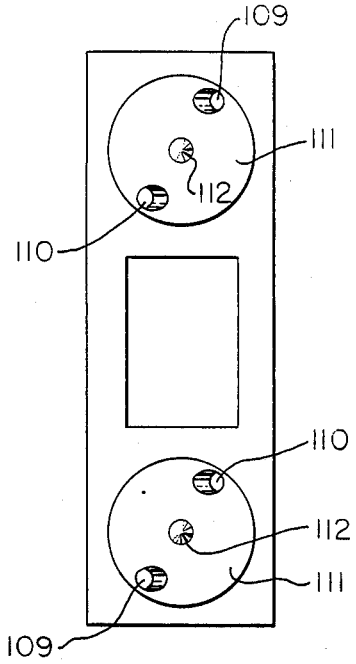
FIG. 18 is a rear elevational view of the strike plate of FIG. 15.
Figure 16:
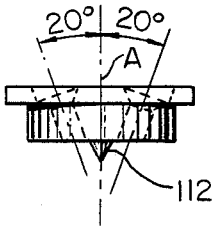
FIG. 16 is an end edge elevational view of the strike plate of FIG. 15.

Additionally, the door edge reinforcement plate 42 is provided with two bosses 48 adjacent opposite ends of the plate, each boss projecting about ¼" from the rear surface 49 of the plate. Each boss is also provided on its end surface 51 remote from the rear surface 49 of the plate with a conical projection or point 52, for a purpose which will hereinafter be explained. Centrally located in the plate is an aperture 53, which may be configured to cooperate with the configuration of the dead bolt or latch with which the plate is used. In FIGS. 27–30, in the interest of clarity, the plate is illustrated apart from the lock mechanism with which it will normally be associated. In FIGS. 11–13, the plate is illustrated attached to and forming a part of the lock mechanism 8, which in this instance is represented as a dead bolt assembly including the reciprocable bolt 54 adapted to project through the aperture 53 when the actuating latch portion 56 of the lock assembly is manipulated by appropriate means (not shown), such as a key or lever or thumb turn mounted on the door in association with face bore 34.

The door edge reinforcement plate and each integral boss 48 is provided with a pair of bores 57 and 58, positioned symmetrically with respect to intersecting planes A and B, both of which are perpendicular to the front face 59 and to each other, the two planes intersecting at the center of the boss and of course each plane bisecting the projecting point 52.

Figure 30:
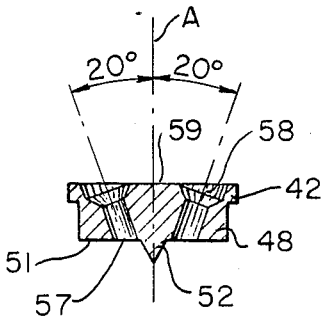
FIG. 30 is cross-sectional view taken in the plane indicated by the line 30—30 in FIG. 27.

As illustrated in FIGS. 13 and 30, each bore 57 and 58 is inclined to the front face of the reinforcement plate by an angle other than 90°. Preferably, the central axis of each bore penetrates the plate and boss at an angle of about 20° from the plane A, but in opposite directions. Thus, bore 57 accommodates screw fastener 61, which extends angularly across the thickness of the door from adjacent the interior surface 33 thereof toward the exterior surface 32 thereof. In like manner, but reversed in direction, the screw fastener 62 extends angularly across the thickness of the door from adjacent the exterior surface 32 toward the interior surface 33. In so doing, it will be seen that both screw fasteners are of a length to penetrate the median plane A and to extend to the opposite side thereof from the side from which it initially penetrates the door material.

The selected length of the screw fasteners determines the proximity of the screw fastener point to the opposite surface of the door when the screw fastener is fully set with its head fully recessed in the plate and boss, as shown, so that no part of the head of either screw fastener projects beyond the front surface or face 59 of the plate. It will thus be seen that the plate 42 and boss cooperate to provide a recessed seat for the screw fastener head, while the shanks of the two oppositely angled screw fasteners cooperate to impose a compressive force on the wood from near one surface to near the opposite surface. Tests have shown that the position of this compressive force across the grain of the wood door effectively resists splitting of the door material under repeated and heavy kicks.

Figure 9:
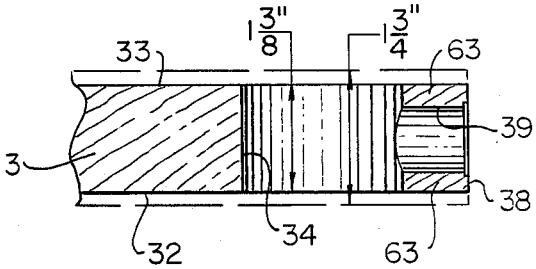
FIG. 9 a horizontal cross-sectional view taken in the plane indicated by the line 9—9 in FIG. 8.
Figure 8:
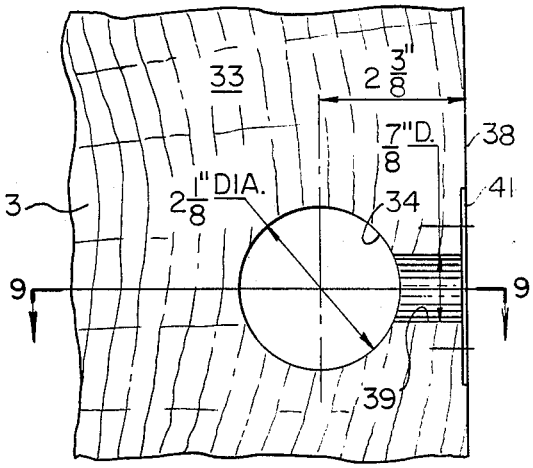
FIG. 8 is a fragmentary elevational view illustrating the conventional spacings of lock assembly bores in the face and edge of conventional doors, shown about 65% of actual size.

This surprising phenomenon, and the need for it, will be readily apparent from a comparison of FIGS. 2, and 8, 9 and 10. For explanatory and comparison purposes, FIGS. 8 and 9 illustrate a section of a conventional door 3, similar to that illustrated in FIG. 2. Dimensions have been applied to illustrate the weakening effect of the bores 34 and 39 on the area of the door in the immediate proximity of the door hardware in a conventional door. Thus, door thicknesses of 1 ⅜" or 1 ¾" are considered standard in the industry. The door edge plate 42 of FIG. 13 is 1 ⅛" wide. If the central axis of each screw fastener is extended, it will be seen that 3" long screw fasteners may be accommodated by a 1 ¾ thick door before the point of each screw penetrates the surface of the door. This length could of course be increased if the door edge plate were made wider.

Figure 10:
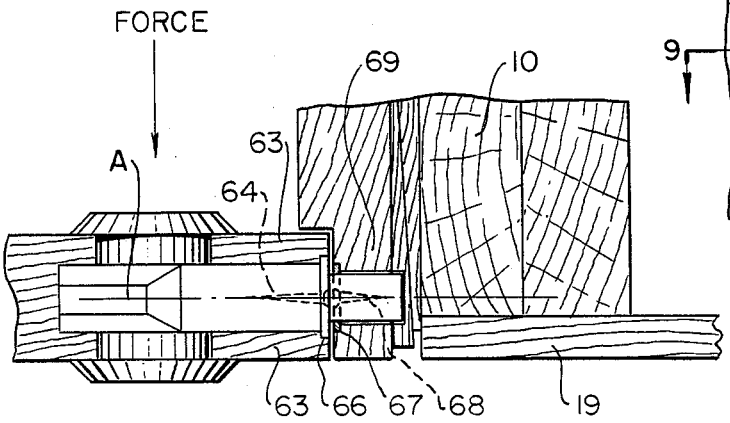
FIG. 10 is a fragmentary horizontal cross-sectional view illustrating a conventional door assembly.

It is important to provide this compressive force on the wood by the action of the oppositely angled screws because the bores 34 and 39 remove so much of the door material to accommodate the lock mechanism that this area of the door is weakened significantly. Referring to FIGS. 9 and 10, webs 63, under the best conditions of a 1 ¾" door with a ¾" bore, are only a mere ½" thick in a plane that bisects the bore horizontally. The conventional screws 64 of a conventional dead bolt or latch plate 66 (FIG. 10) are only 1 ⅝" apart, thus positioning the axis of the conventional perpendicular screws 64 only 7/16" from the top and bottom peripheries of bore 39 that intersect vertical and median plane A.

The effect of this conventional construction on the door stile when an unauthorized entry force, such as a kick, is imposed on the outside of the door is to cause the door stile to split along the plane A. The conventional screw 64, perpendicular to the edge of the door, or parallel to the inside and outside surfaces, weakens the door in the plane A by imposing a splitting force on the wood. When the kick is delivered to the outside of the door, either one or both of two things occur. Either the door splits along plane A as a result of lateral force imposed on the relatively thin web 63 by the lock mechanism, or the force imposed by the bolt (or latch) 54 on the conventional strike plate 67, secured by conventional short screws 68 driven perpendicular into the strike jamb 69, splits the strike jamb in the plane of the screws and strips the strike plate from the strike jamb, or both the door stile and the strike jamb split, thus releasing the door.

Now, comparing this conventional construction with my invention as illustrated in FIG. 2, it will be seen quite clearly that the two elongated screw fasteners 62 and 63 compress the wood between them in a cooperative manner, reinforcing the door instead of weakening it, and resisting any tendency of the door stile to split as discussed above. In like manner, my invention, as applied to the strike plate 23, which is secured not only to the strike jamb but also to the structural members 10 by the elongated screw fasteners 24, prevents splitting of the strike jamb, and prevents stripping of the strike plate from the jamb. In this connection, it is important to note that the bores 27 (FIG. 23) that accommodate the screws 24, are angled in door-closing direction at an angle of about 30° to the plane A. Thus, any force imposed from the outside tending to laterally dislodge the strike plate, will impose an axially directed component of force on the screws 24, rather than solely a splitting force on the jamb as with a conventional strike plate secured by conventional short screws secured perpendicularly only in the strike jamb.

These concepts and principles embodied as illustrated, produce a virtually impenetrable entry door security system that transfers the weak link of an entry door assembly from the door stile and strike jamb to the lock mechanism itself. Tests conducted by police authorities have demonstrated that the metal parts of the lock assembly are bent and disassembled by repeated kicks before the door stile or strike jamb split.

As illustrated in FIGS. 3–7, these concepts and principles have been embodied in the hinged union of the door to the hinge jamb. As discussed above, unauthorized entry into a premise is sometimes attempted by applying a destructive force to the door adjacent to the hinge connection of the door to the hinge jamb. The hinge jamb is usually fabricated from softwood, and the conventional screws that hold the hinge to both the door and to the hinge jamb are frequently no longer than ¾". This, then, defines the third weak point in the security of the door assembly, and the means illustrated in FIGS. 3 through 7 reinforce this union between the door and the door frame to prevent, or make much more difficult, unauthorized forced entry through the door.

Figure 3:
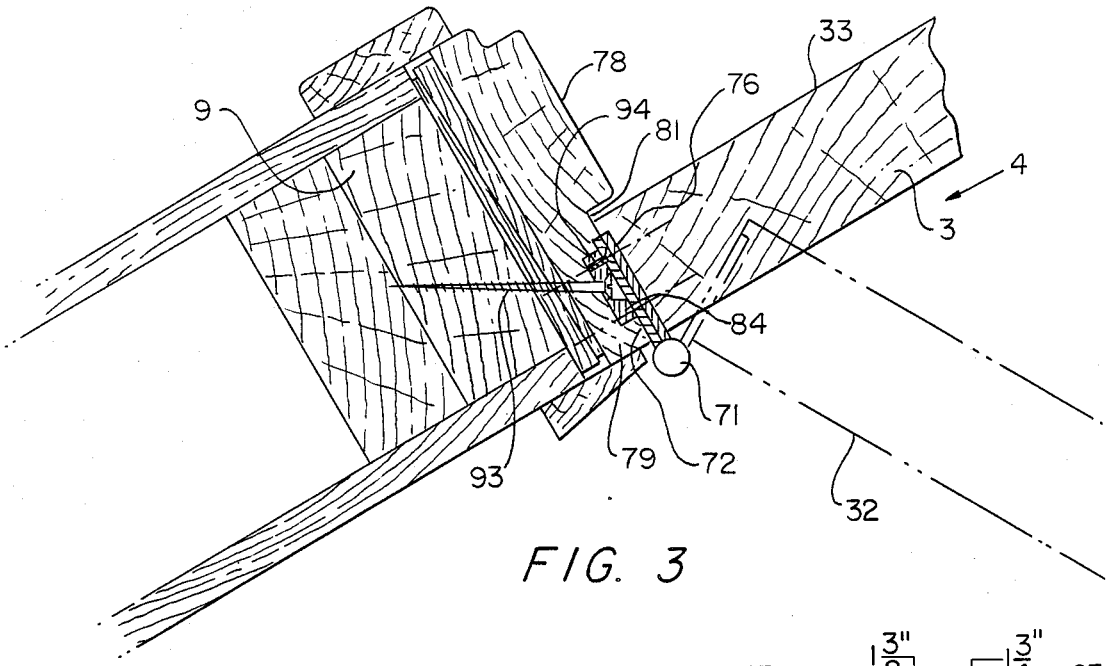
FIG. 3 is a fragmentary horizontal cross-sectional view taken in the plane indicated by the line 3—3 in FIG. 1, shown approximately 50% actual size and illustrating one aspect of my invention.
Figure 4:
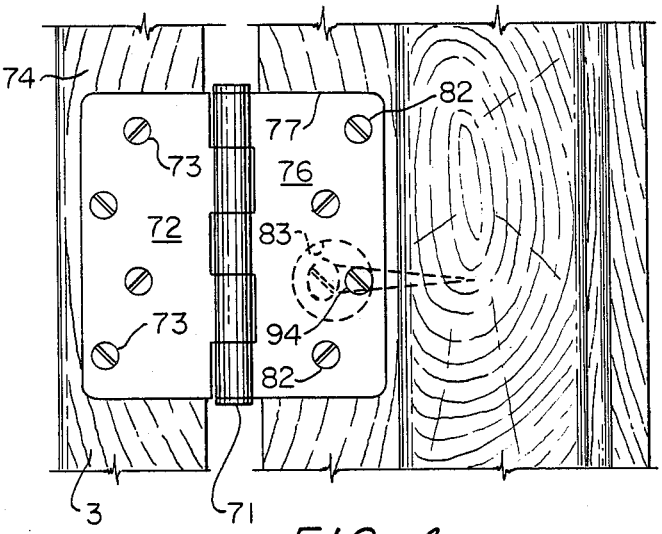
FIG. 4 is a fragmentary elevational view taken in the direction indicated by the arrow 4 in FIG. 3, but with the door swung wide open to reveal the face of the hinge.

Referring to FIG. 3, it will there be seen that the door 3 is attached to the hinge jamb 5 by a hinge designated generally by the numeral 71. The hinge is provided with one leaf 72 that is attached by appropriate screw fasteners 73 to the hinge edge 74 of the door, while the other leaf 76 of the hinge fits into a recess 77 that is routed into the hinge jamb 5. The outer edge portion of the hinge jamb 5 is rabbetted to provide a stop 78 and a thinned-down portion 79 within the face 81 in which the recess 77 is routed in a configuration and to a depth to snugly receive the hinge leaf 76 as illustrated.

The hinge leaf 76 is secured to the hinge jamb 5 within the recess 77 by screw fasteners 82 of conventional size and placement, it being noted that since the mortised recess 77 is formed in the thinned-down section 79 of the hinge jamb, if the hinge leaf 76 is secured only to this thinned-down portion of the hinge jamb only by the screws 82, it requires not much more than one or two strong kicks against the outer surface 32 of the door immediately adjacent the hinge to cause splitting and tearing away of the thinned-down portion 79 of the hinge jamb, thus giving access to the interior of the premises.

Figure 5:
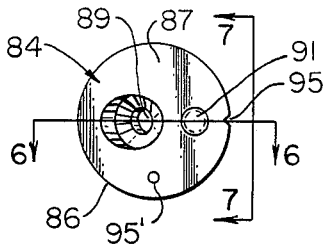
FIG. 5 is a front elevational view of the hinge jamb reinforcing plate apart from other structure, illustrating the three bores that extend through the plate. The plate is shown actual size.
Figure 7:
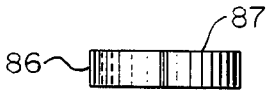
FIG. 7 is a side elevational view illustrating the index notch formed in the cylindrical periphery.

As stated above, it is one of the objects of the invention to reinforce this area of the door assembly to prevent such splitting or tearing away from occurring. To effect this purpose, there is provided in the bottom of the recess 77 a further recess 83 having a depth of approximately ¼" and in this instance being circular in its configuration with a diameter of 1". It will of course be understood that any other appropriate configuration other than circular may be utilized but would be correspondingly more difficult to implement. The recess 83 is adapted to snugly receive a reinforcement plate 84, best illustrated in FIGS. 5, 6 and 7, the reinforcement and a rear face 88. The plate may be formed of tough plastic, but metal is preferred. Formed in the reinforcement plate 84 are a pair of bores 89 and 91 spaced along a common diameter of the circular reinforcement plate as illustrated in FIG. 5. The bore 89 is formed in the plate so that it passes through the thickness of the plate at an angle of approximately 30° to the central axis 92 of the plate. As illustrated in FIG. 5, the bore 89 is configured to correspond to the configuration of the head of a screw fastener 93 and a portion of its shank.

The screw fastener 93, as illustrated in FIG. 3, passes at an angle through the reinforcement late 84, passes also through the hinge jamb 5, and deeply into the vertical support members 9 to which the hinge jamb is secured. It will thus be seen that in order to effect dislodgement of the reinforcement plate 84 from the recess in which it is snugly seated, it is necessary that the force be so strong as to strip the elongated screw fastener 93 axially from the solidly anchored vertical support members 9. Because of the angle at which the screw is driven into the wall support members any such force must impose tensile loads on the screw to strip it from the wood. Tests have indicated that it takes much more than the force exerted by a strong kick, or even multiple kicks, to effect such a dislodgement of the screw fastener 93 and reinforcement plate 84.

Figure 6:
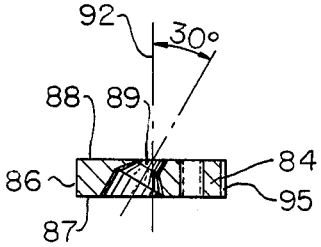
FIG. 6 is a cross-sectional view of the plate, taken in the plane indicated by the line 6—6 in FIG. 5.

The bore 91 formed in the reinforcement plate 84 is perpendicular to the face 87 and is internally machine-threaded to receive a machine-threaded screw fastener 94 as illustrated in FIGS. 3 and 6. The screw fastener 94 securely fastens the hinge leaf 76 to the reinforcement plate 84, and thus cooperates with the screw fasteners 82 and the elongated screw fastener 93 to securely anchor the hinge leaf 76 to the associated wall structure.

As illustrated, the plate 84 is also provided with an indexing notch 95 in the periphery positioned so that it lies in alignment along the common diameter with the bore 89 and 91. The notch facilitates orientation of the plate 84 so that the axis of bore 91 lines up the axis of an appropriate bore in he hinge leaf. The bore 95' is laterally offset from the common diameter which includes bores 89 and 91 and notch 95, and is used during assembly to receive a brad to retain the plate 84 in proper position during assembly.

From the foregoing, it will be apparent that the door assembly forming the subject matter of this invention has been totally reinforced by the application of individual reinforcement means at the weak points of the assembly, which individual reinforcement means cooperate with each other and with the door with which they are associated to prevent an unauthorized forced entry through the door. Thus, the heavy duty dead bolt strike plate illustrated in FIGS. 23–26 cooperate with the bolt structure illustrated in FIGS. 2, 11 and 13, and the reinforcement door edge plate illustrated in FIGS. 11–13, to materially strengthen the union of the door assembly and the wall structure in the area of the lock assembly. In like manner, the other weak point of the door assembly, namely, the hinge line of the door, has been reinforced by the reinforcement plate 84 illustrated in FIGS. 3 through 7, to thus eliminate the possibility that a would-be burglar, failing to rupture the lock assembly, will successfully turn his attention to the hinge line of the door and thus gain unauthorized entry into the premises.

To illustrate the versatility of the concepts and principles discussed above, these concepts and principles have been embodied in different structures for varying applications. Thus, in FIG. 14, the dead bolt lock assembly of FIG. 11 has been applied to a double-door installation having an active door 96, an inactive door 97, an astragal 98 closing the gap 99 and fixed to the edge of the inactive door. As applied in this installation, the door edge reinforcement plate 101 and integral bosses 102, with lock assembly attached, are recessed into the door edge as previously described and anchored by two elongated screw fasteners 103 and 104 at each end of the door edge face plate. In like manner, the strike plate 10 is recessed into the astragal (as compared to the strike jamb), and anchored by two pairs of elongated screw fasteners 107 and 108 penetrating opposite end portions of the strike plate and extending into the door stile from opposite directions.

For this installation, because the strike plate 106 is anchored to the edge of the inactive door 97 rather than to a strike jamb as in FIG. 2, it should be noted that the strike plate 106, as depicted in FIGS. 15 through 18, is provided with a pair of bores 109 and 110 adjacent each end of the plate, the bores of each pair being angled in opposite directions and being inclined to the plane A (FIG. 16) at about 20°. Each of the bosses 111 are provided with a central conical projection 112 as previously discussed.

Figure 14:
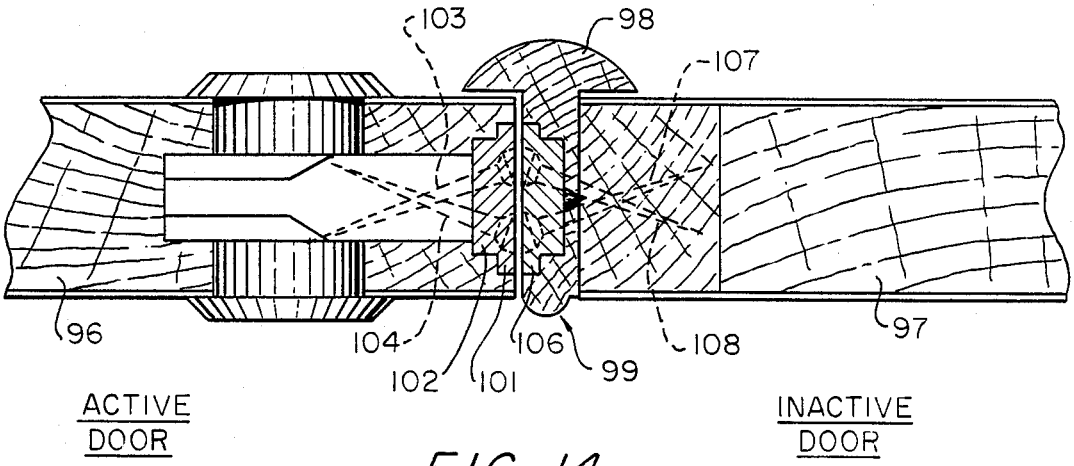
FIG. 14 is a fragmentary cross-sectional view illustrating the strike plate and door-edge plate of the invention applied in a dead bolt application to the inactive door of a double-door installation.

In FIGS. 19–22, the invention has been applied to the latch strike plate for a double door installation such as depicted in FIG. 14. Here, the strike plate 113 is provided with a latch aperture 114, one edge 116 of which is relived at its end 117 that the edge 116 projects freely between the relief radiuses. This enables the edge 116 to be dressed with a file to adjust the tolerance of the latch bolt in the aperture. Additionally, the strike plate is provided with a flange 118 against which a spring-pressed latch may impinge when the door is closed. Note also that this strike plate, since it is to be installed as part of the latch assembly of a double door installation, is provided with reinforcement bosses 119 each of which is provided with a central pointed projection 120 and two oppositely angled bores 121 and 122 through which may be projected elongated screw fasteners as previously discussed.

Figure 19:
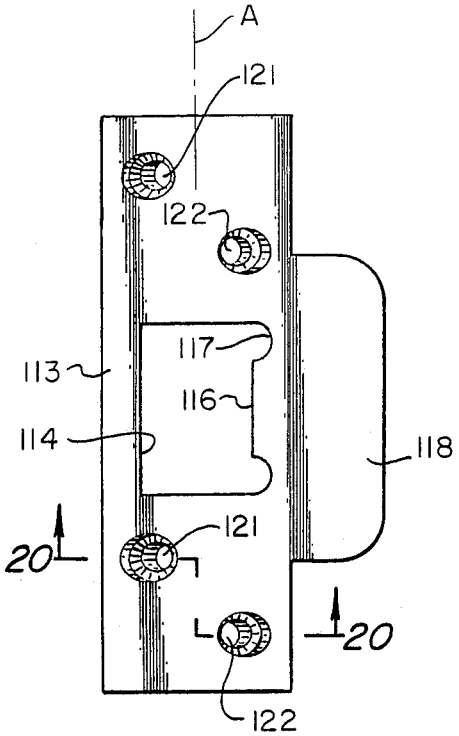
FIG. 19 is a front elevational view of a latch strike plate as might be applied to the inactive door of a double-door installation, shown full size.
Figure 21:
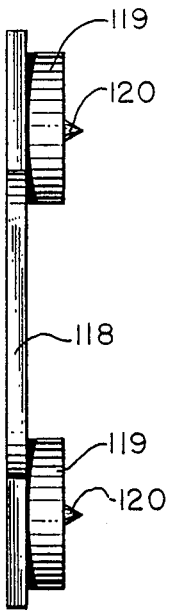
FIG. 21 is a side edge elevational view of the latch strike plate of FIG. 19.
Figure 22:
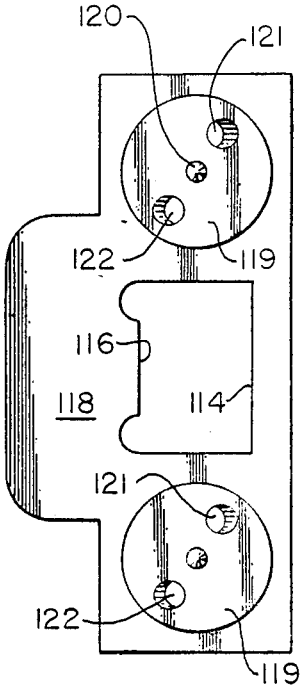
FIG. 22 is a rear elevational view of the latch strike plate of FIG. 19.
Figure 20:
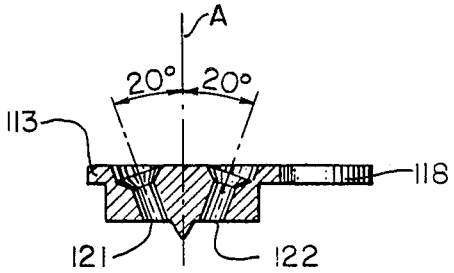
FIG. 20 is a cross-sectional view along line 20—20 of the latch strike plate of FIG. 19.
Figure 31:
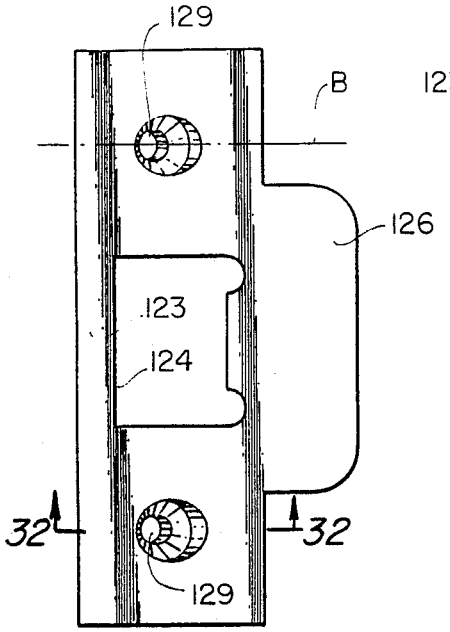
FIG. 31 is a front elevational view of a latch strike plate as might be applied to the strike jamb of a single exterior entry door, shown actual size.
Figure 33:
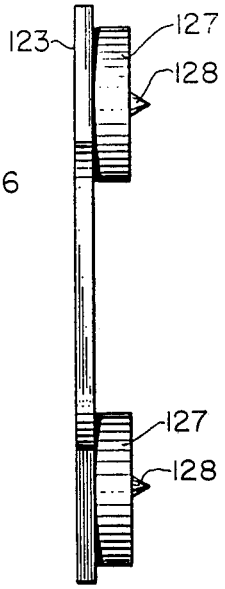
FIG. 33 is a side edge elevational view of the latch strike plate of FIG. 31.
Figure 34:
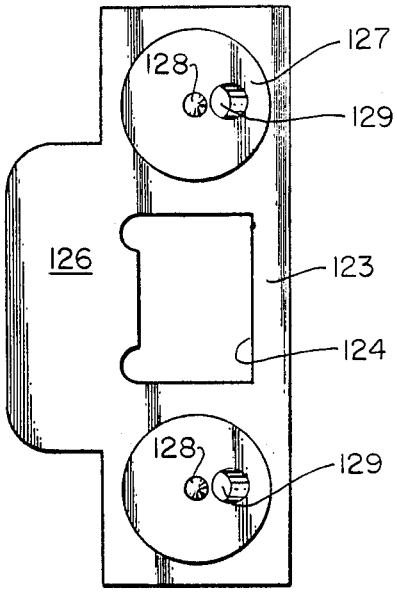
FIG. 34 is a rear elevational view of the latch strike plate of FIG. 31.
Figure 32:
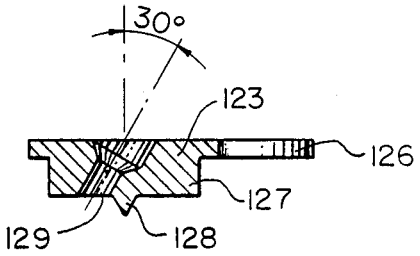
FIG. 32 is a cross-sectional view taken along line 32—32 of the latch strike plate of FIG. 31.

Comparing FIG. 19 with FIG. 31, it will be seen that the basic configuration of the latch strike plate 113 of FIG. 19 is identical to the latch strike plate of FIG. 31. The difference in these two strike plates is accounted for by the fact that the strike plate of FIG. 31 is adapted for attachment to a strike jamb rather than a door edge or door stile as discussed above in connection with FIGS. 14–20. Thus, in FIG. 31, latch strike plate 123 is provided with a latch aperture 124, a flange 126, cylindrical bosses 127 integral with and projecting from the rear surface of the strike plate and each having a conical pointed projection 128 extending from the surface of the boss as previously described. In this embodiment however, only one bore 129 is provided in each end of the strike plate, passing as before through the associated boss and strike plate at an angle of about 30° to the plane A perpendicular to the face of the plate and including both pointed projections 128. The screw fastener inserted through the bore 129 thus lies substantially totally on one side of the plane A and the shank of the screw fastener does not intersect with the extended plane A as is true with the screw fasteners of FIGS. 16 and 20.

Figure 35:
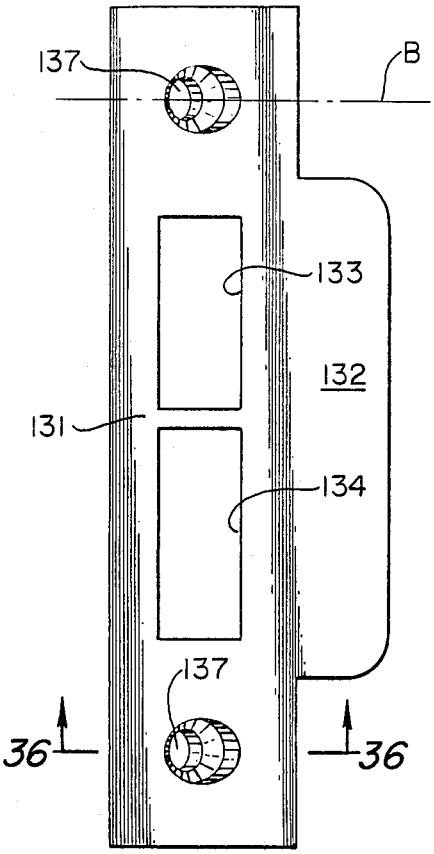
FIG. 35 is a front elevational view of the latch strike plate a single door equipped with a mortice lock assembly including both a latch bolt and a dead bolt.
Figure 37:
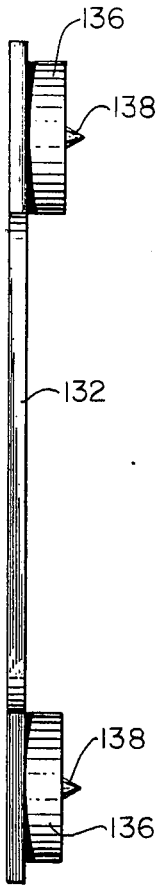
FIG. 37 is a side edge elevational view of the mortice lock strike plate of FIG. 35.
Figure 38:
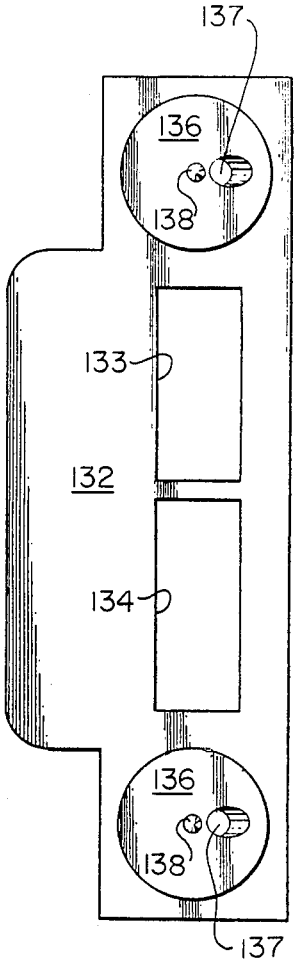
FIG. 38 is a rear elevational view of the mortice lock strike plate of FIG. 35.
Figure 36:
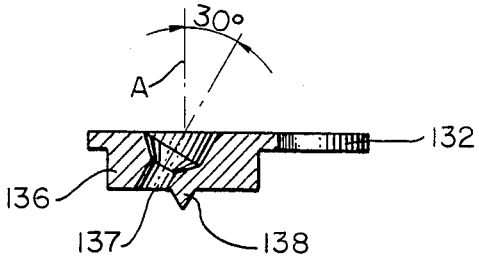
FIG. 36 is a cross-sectional view along line 36—36 of the mortice lock strike plate of FIG. 35.
Figure 39:
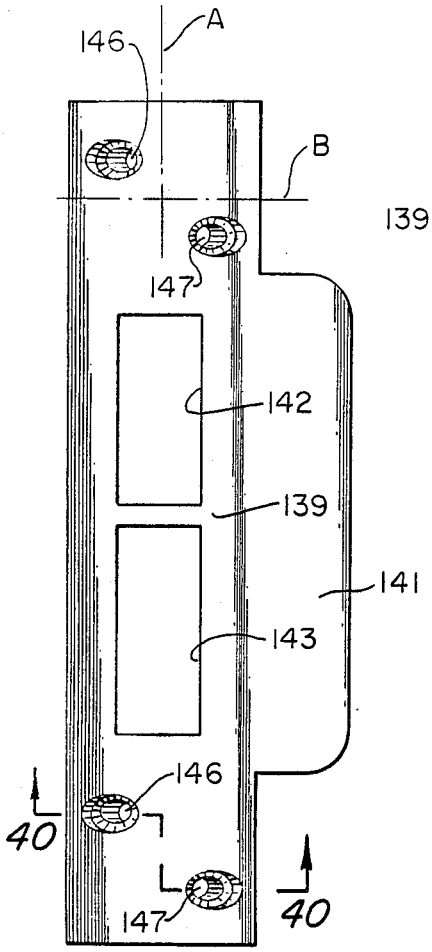
FIG. 39 is a front elevational view of a latch strike plate for the inactive side of a double-door installation where the active door is equipped with a mortice lock assembly including both a latch bolt and a dead bolt.
Figure 41:
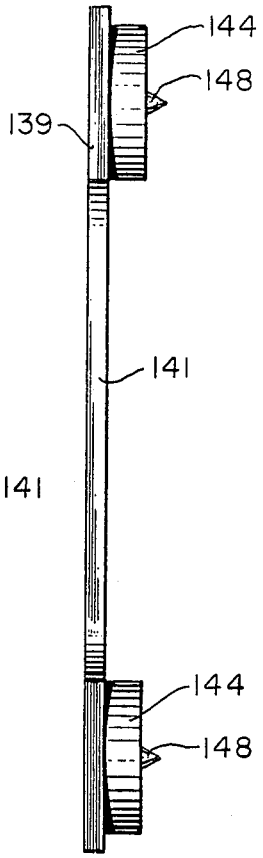
FIG. 41 is a side edge elevational view of the latch strike plate of FIG. 39.
Figure 42:
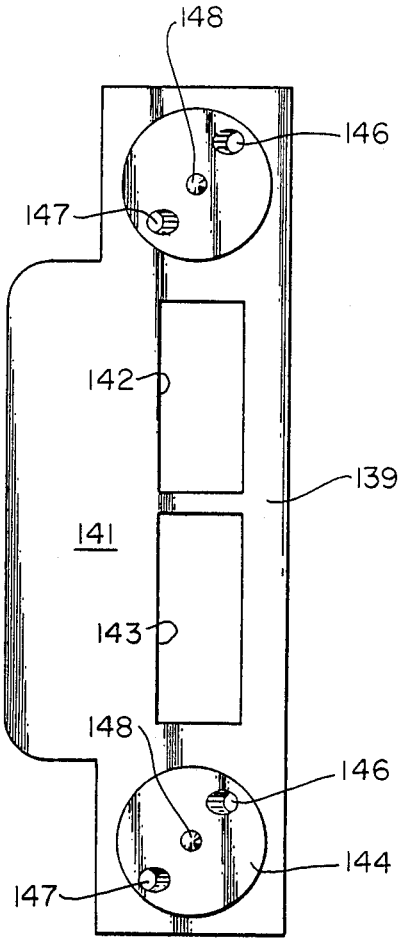
FIG. 42 is a rear elevational view of the strike plate of FIG. 39.
Figure 40:
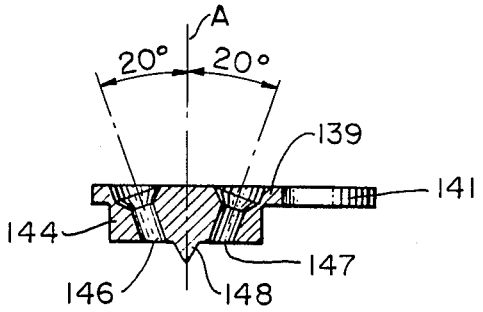
FIG. 40 is a cross-sectional view along line 40—40 of the latch strike plate of FIG. 39.

Referring to FIGS. 35–38, the strike plate 131 there illustrated is designed to cooperate with a mortise-type lock assembly that incorporates both a dead bolt and a spring latch in the same lock assembly. Usually, both the dead bolt and spring latch are operable by a single lever or knob. Thus, the strike plate 131 is provided with a latch impingement flange 132, a dead bolt aperture 133, a spring latch aperture 134, and integral cylindrical bosses 136 adjacent opposite ends of the strike plate. As shown in FIG. 36, each boss is penetrated by a single bore 137 extending through the plate and boss at an angle other than 90° , preferably 30° from the plane A. Each boss is also provided with a pointed conical projection 138 centrally disposed on the boss. As explained previously, a single bore 137 is provided at each end of the plate to accommodate a single elongated screw fastener in each bore for anchoring the ends of the strike plate to the associated strike jamb and structural support members to which the strike jamb is secured.

Figure 23:
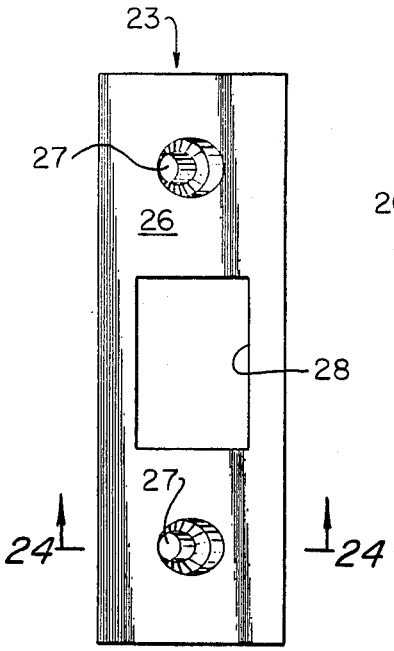
FIG. 23 is a front elevational view of a dead bolt strike plate as might be applied in a single-door installation, shown actual size.
Figure 25:
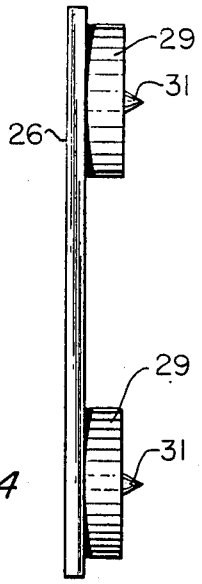
FIG. 25 is a side edge elevational view of the dead bolt strike plate of FIG. 23.
Figure 26:
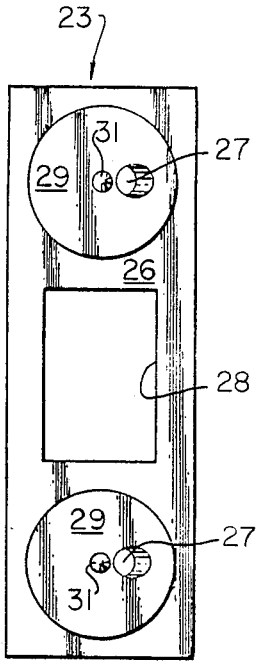
FIG. 26 is a rear elevational view of the dead bolt strike plate of FIG. 23.
Figure 24:
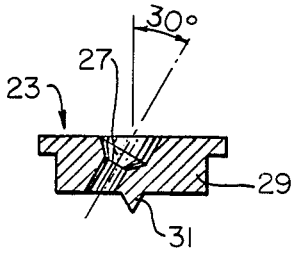
FIG. 24 is a cross-sectional view along line 24—24 of the dead bolt strike plate of FIG. 23.
Figure 27:
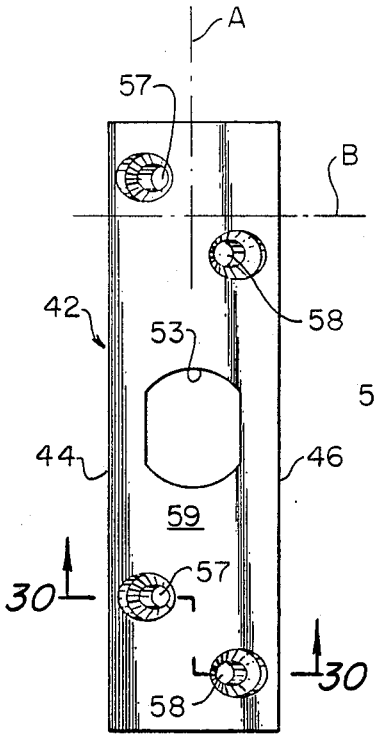
FIG. 27 is a front elevational view of a door edge face plate as might be applied in a dead-bolt installation.
Figure 28:
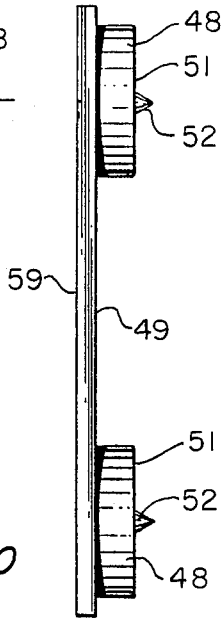
FIG. 28 is a right side elevational view of the door edge face plate illustrated in FIG. 27.
Figure 29:
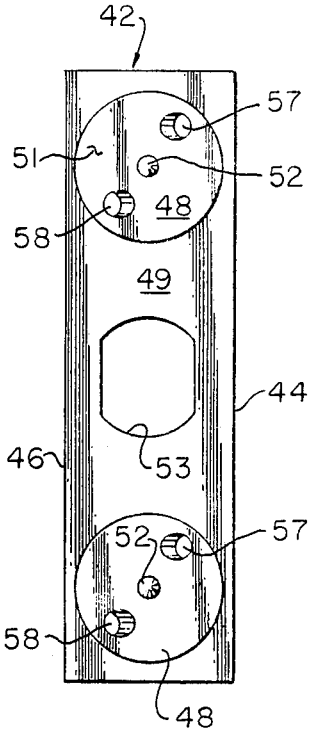
FIG. 29 is a rear elevational view of the door edge plate illustrated in FIG. 27.

FIGS. 39–42 illustrate a strike pate 139 specially adapted for installation in the door edge stile of the inactive door of a double-door installation similar to that illustrated in FIG. 14 but incorporating a mortise-type lock assembly. Like the strike plate 131 of FIG. 35, this strike plate includes a latch impingement flange 141, a dead bolt aperture 142, a spring latch aperture 143, and two bosses 144, positioned adjacent opposite ends of the strike plate. Each of the bosses is provided with bores 146 and 147, constituting a pair related to planes A and B in the same way a bores 57 and 58 in plate 42 (FIG. 27) are related to planes A and B. In this regard it should be noted that the bores 14 and 147 are on opposite sides of both planes A and B, while in strike plates such as illustrated in FIGS. 23, 31 and 35 where only one bore is provided through each boss, the bore axis is included in plane B. As before, the bosses 144 are each provided with a centrally disposed conical projection 148, useful to form a depression in the door edge or strike jamb during installation to precisely position and guide the spade bit or drill when the circular recesses to receive the bosses are formed.

Having thus described the invention, what is believed to be new and novel and sought to be protected by letters patent of the United States is as follows:

I claim:

1. As an article of manufacture, a component for use in a reinforced entry door assembly, said reinforced entry door assembly including a pair of spaced vertical structural members supporting a door frame having strike and hinge jambs adapted to cooperate with a door mounted thereon having a lock stile and provided with a lock assembly having a bolt adapted to engage said strike jamb when said door is closed, said component comprising:

(a) a metal door-edge plate having front and rear surfaces and operatively associated with said lock assembly and including at least one aperture dimensioned to provide a snug sliding fit around said bolt;

(b) a cylindrical boss means projecting from the rear surface of the door-edge plate adjacent each opposite end and adapted to extend snugly into a complementarily configured socket-like recess formed in said door edge lock stile to reinforce said lock stile; and (c) at least one bore adjacent each end of the door-edge plate having a central axis inclined to the front and rear surfaces of the door-edge plate at an angle other than 90° and extending through said means projecting from the rear surface of the door-edge plate, whereby an elongated screw fastener may pass through said bore at an angle other than 90° to said front and rear surfaces to anchor the door-edge plate to said lock stile;

(d) said aperture dimensioned to provide a snug sliding fit around said bolt being positioned in said door-edge plate intermediate said means projecting from the rear surface of the door-edge plate; and (e) each said boss means comprising a solid cylindrical body having an end face spaced from the rear surface of the door-edge plate, and having a conical projection centrally disposed on said end face, whereby during installation of the door-edge plate, the door edge plate may be appropriately positioned on the lock stile and lightly tapped so that said conical projections punch depressions in said lock stile to accurately mark where the lock stile is to be bored to receive said bosses.

2. The door-edge plate according to claim 1, in which a pair of bores are provided in the door-edge plate adjacent each end, the bores of each pair of bores being inclined at mutually converging angles other than 90°, both said bores of each pair extending through said means projecting from the rear surface of said door-edge plate.

3. The door-edge plate according to claim 2, in which the bores of each pair are axially and transversely spaced, and one of said bores of each pair is inclined in the direction in which the door closes while the other bore of each pair is inclined in the direction in which the door opens, whereby a force exerted on the door in a door-opening direction when said bolt is engaged with a strike plate will impose tension on said elongated screw fastener inclined in the direction in which the door closes.

4. The door edge plate according to claim 2, in which the bores of each pair thereof have axes coincident with parallel planes spaced on opposite sides of a central plane that includes said centrally disposed conical projection, said bores of each pair being inclined to the front surface of the door-edge plate.

5. The door-edge plate according to claim 1, in which a pair of bores are provided in the door-edge plate adjacent each opposite end, the bores of each pair symmetrically displaced axially and transversely in relation to said associated centrally disposed conical projection.

6. The door-edge plate according to claim 2, in which the bores of each pair thereof have axes coincident with parallel planes spaced on opposite side of a central plane that includes said centrally disposed conical projection, said bores of each pair being inclined at mutually converging angles of about 20° to the front surface of the door-edge plate.

7. As an article of manufacture, a component for use in reinforcing a door assembly adapted to be mounted between two wall support members, said door assembly including a door frame having a hinge jamb secured to one said wall support members and adapted to cooperate with a door provided with a plurality of hinges to pivotally support the door onto the hinge jamb, said component comprising:

(a) a circular metal reinforcement plate adapted to be disposed between at least one of said hinges and said hinge jamb to reinforce the union therebetween, said plate being adapted for securement to said hinge and recessed in said hinge jamb for attachment thereto and to said wall support member whereby force applied against said door and hinge is resisted by said plate;

(b) said reinforcement plate being provided with a pair of bores spaced along a common diameter of said plate, one of said bores having an axis that converges toward the axis of the other bore, one of said bores being adapted to receive a screw fastener to secure the reinforcement plate to the hinge, and the other bore being adapted to receive a screw fastener to secure the reinforcement plate to said hinge jamb and said wall support member; and (c) a third bore spaced from said pair of bores and adapted to receive a brad whereby said reinforcement plate may be temporarily anchored in position in said hinge jamb recess prior to attachment of a hinge to said reinforcement plate.

8. The combination according to claim 7, in which said bore adapted to receive a screw fastener to secure the reinforcement plate to said associated hinge is provided with machine threads to receive a complimentarily threaded screw fastener.

9. The combination according to claim 7, in which said bore adapted to receive a screw fastener to secure the reinforcement plate to the hinge jamb and said wall support member is inclined at an angle other than 90° to the reinforcement plate.

10. The combination according to claim 7, in which said reinforcement plate is provided with an indexing notch on the outer circular periphery thereof at the point where the common diameter along which said pair of bores are spaced is intercepted by said periphery.

11. The combination according to claim 7, in which said bore adapted to receive a screw fastener for attachment of the reinforcement plate to the hinge lies between said indexing notch and said bore adapted to receive a screw fastener to secure the reinforcement plate to said hinge jamb and said structural members.

12. The combination according to claim 7, in which said bore having an axis that converges toward the axis of the other bore also converges toward said indexing notch.

* * * * *

UNITED STATES PATENT AND TRADEMARK OFFICE

CERTIFICATE OF CORRECTION

PATENT NO. : 4,832,388

DATED : May 23, 1989

INVENTOR(S) : Anthony R. Lozano

It is certified that error appears in the above-identified patent and that said Letters Patent is hereby corrected as shown below:

On the title page, item [22], "Mar. 14, 1989" should be --Mar. 14, 1986--.

Signed and Sealed this

Twenty-eighth Day of November 1989

*Attest:*

JEFFREY M. SAMUELS

*Attesting Officer* *Acting Commissioner of Patents and Trademarks*